US005358150A

United States Patent [19]

Scheuble et al.

[11] Patent Number: 5,358,150

[45] Date of Patent: Oct. 25, 1994

[54] PRESSURIZED FLUID DISPENSING DEVICE

[75] Inventors: Gustav A. Scheuble, Des Plaines, Ill.; Oscar Malmin, Boise, Id.; Fritz Kohnke, Palatine, Ill.

[73] Assignee: MPL Technologies, Inc., Franklin Park, Ill.

[21] Appl. No.: 972,577

[22] Filed: Nov. 6, 1992

Related U.S. Application Data

[63] Continuation-in-part of Ser. No. 863,382, Apr. 3, 1992, abandoned, which is a continuation of Ser. No. 584,159, Jul. 3, 1990, abandoned.

[51] Int. Cl.[5] ..... B65D 83/00

[52] U.S. Cl. ..... 222/401

[58] Field of Search ..... 222/189, 386, 398, 401, 222/464, 400.8; 417/544, 555.1, 903; 604/146; 251/6, 149.6

[56] References Cited

U.S. PATENT DOCUMENTS

| | | | |
|---|---|---|---|
| 734,319 | 7/1903 | Grahn | 222/401 |
| 956,052 | 4/1910 | Dorment | 222/401 X |
| 1,220,243 | 3/1917 | Leitch | 604/146 |
| 1,563,627 | 1/1925 | Hein | 604/231 X |
| 1,772,425 | 8/1930 | Lebelque et al. | 222/401 |
| 2,743,847 | 5/1956 | Pollak | 222/383 X |
| 2,880,939 | 4/1959 | Esmay | 239/320 X |
| 3,191,807 | 6/1965 | Rodrigues, Jr. | 222/380 X |
| 3,538,950 | 11/1970 | Porteners | 251/149.6 X |
| 4,036,232 | 7/1977 | Genese | 604/250 X |
| 4,175,704 | 11/1979 | Cohen | 239/320 |
| 4,406,440 | 9/1983 | Kulle et al. | 251/6 |
| 4,537,334 | 8/1985 | Spengler et al. | 222/401 |
| 4,700,872 | 10/1987 | Keyes | 222/401 |
| 4,782,982 | 11/1988 | Ellison | 222/401 |
| 4,919,389 | 4/1990 | Hoekwater et al. | 251/6 |

FOREIGN PATENT DOCUMENTS

| | | |
|---|---|---|
| 25864 | 9/1906 | Austria . |
| 391180 | 6/1908 | France . |
| 145791 | 1/1930 | Switzerland . |

*Primary Examiner*—Andres Kashnikow
*Assistant Examiner*—Kenneth Bomberg
*Attorney, Agent, or Firm*—Pravel, Hewitt, Kimball & Krieger

[57] ABSTRACT

A pressurized fluid dispensing apparatus for use with a precision-controlled fluid placement device is disclosed. The apparatus comprises a reservoir fillable through a circular port closeable by a removable cap. The reservoir is adapted to receive a plunger and communicates with a first check valve to provide compressed air to dispense fluid from the reservoir through a discharge channel into the fluid placement device. A control is provided on the fluid placement device to regulate the flow of the liquid.

14 Claims, 3 Drawing Sheets

FIG. 3
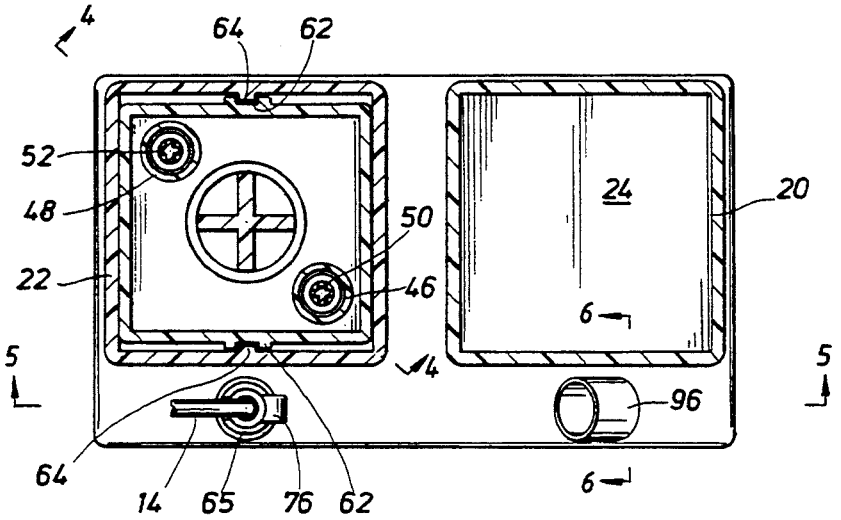
FIG. 4
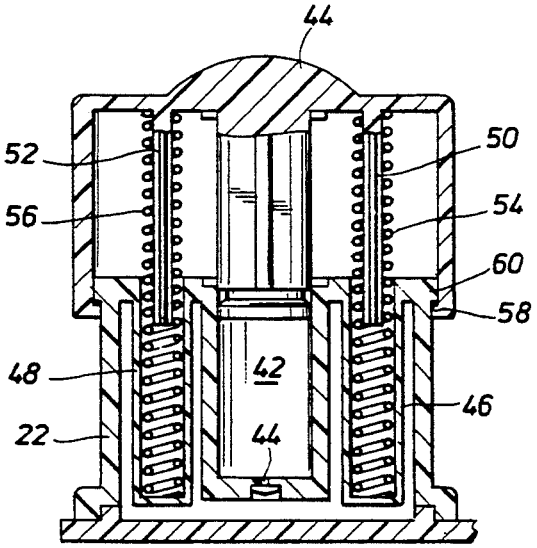
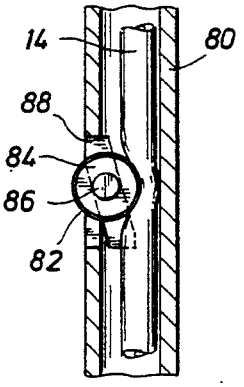
FIG. 7
FIG. 5
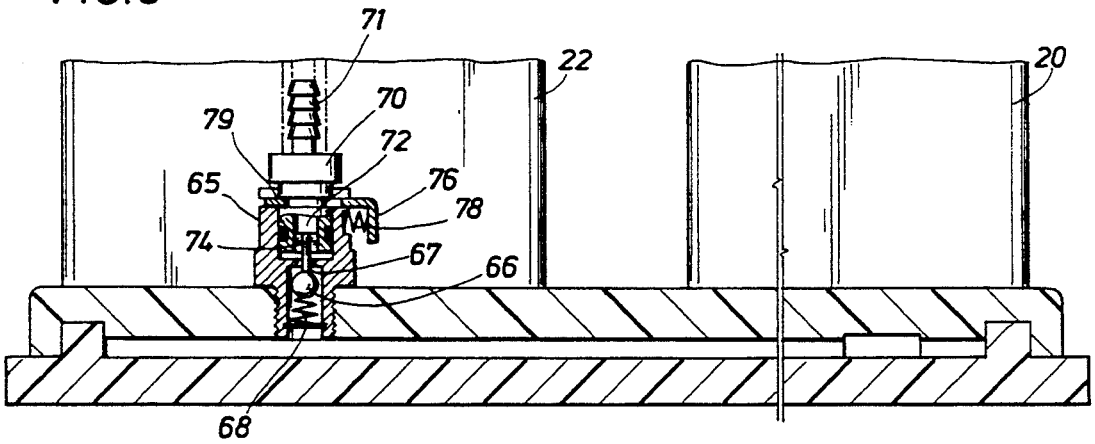

PRESSURIZED FLUID DISPENSING DEVICE

Related Application Data

This patent application is a continuation-in-part of application Ser. No. 863,382, filed Apr. 3, 1992, now abandoned which is a continuation of application Ser. No. 584,159, filed Jul. 3, 1990 now abandoned.

BACKGROUND OF THE INVENTION

The invention of this application relates to a pressurized fluid dispensing apparatus. More particularly, this invention relates to such an apparatus for use where a directed stream of fluid can be controlled in, for example, a subgingival irrigation system.

Various fluid dispensing pumps and sprayers have been previously suggested. Keyes et al, U.S. Pat. No. 4,700,872, describes a pump for dispensing liquid via a syringe in which a hollow cylinder is mounted. The cylinder is connected to the chamber by a first normally closed check valve. A hollow plunger, which receives a liquid charge, reciprocates in the cylinder and is connected thereto by a second normally closed check valve. On the out-stroke of a piston, the liquid in the piston is sucked through the second normally closed check valve into the cylinder and, on the instroke of the plunger, the liquid is forced through the first normally closed check valve into the chamber wherein it is maintained under pressure created by the pumping action of the plunger. An outlet tube leads from the lower part of the chamber to a syringe and a normally closed pinch valves in the syringe is manually operable to permit liquid under pressure to be squirted from the syringe.

Spengler et al, U.S. Pat. No. 4,537,334, describes a reinforced plastic bottle or vessel with a relatively large neck with buttressed threads and a beveled rim on its neck onto which threads is screwed a cap assembly. The cap assembly comprises a plastic cap base member having an integral handle and a nozzle connection, a plastic manual air pump, a plastic siphon, a valve and spray nozzle assembly, and a leer to operate the valve. The air pump is supported by an integral flange and it depends vertically from the cap base member into the bottle with a disc-type check valve at its bottom.

Cohen, U.S. Pat. No. 4,175,704, describes a non-aerosol type spray device comprising a container for housing a liquid material to be dispensed and a plunger slidable as a piston within the container and an elongate tubular member for actuating the plunger with a bore extending continuously therethrough for communication with the interior of the container at one end. There is additional communication with a spray nozzle at the other end for passage of the liquid material from the container through the bore to the spray nozzle in response to displacement of the plunger.

Genese, U.S. Pat. No. 4,036,232, describes an aspiration unit which affords a uniform suction level for aspirating fluids from body cavities. The unit comprises a double piston member, a first head of which is in sealing engagement with a syringe barrel and the second head of which is oppositely disposed and contained in a telescoping member which is also receivable in the syringe barrel. Upon movement of the telescoping member outwardly from the syringe barrel, a vacuum will be created in the telescoping member as well as in that portion of the barrel member between the first piston member and the nozzle which is closed from the atmosphere by means of a valve. Upon insertion of a flexible tube into a body cavity and opening of the valve, fluid will be aspirated into the syringe barrel by means of the partial vacuum created in the syringe barrel and in the telescoping member.

Rodrigues, Jr., U.S. Pat. No. 3,191,807, describes a liquid dispensing device for dispensing ultra-micro volumes of liquid. The dispensing device comprises a syringe having a longitudinal passageway for a piston assembly and includes an enlarged recess at its upper end. The passageway leads to an intake-discharge member. The flow into the chamber is controlled by an intake valve assembly and a discharge valve assembly controls flow from the chamber. The piston assembly in the passageway has a piston adapted to alter the effective volume of the intake-discharge chamber during reciprocation. The stroke of the piston assembly is adjustably controlled by a plunger.

Esmay, U.S. Pat. No. 2,880,939, describes a device for spraying liquid materials in a finally divided or atomized form. The spraying device comprises an outer, elongated cylindrical tube made of transparent material and plunger supply tube also made of a transparent material loosely telescoped within the upper end of the outer tube and having a length of the same order of magnitude as the outer tube. The plunger tube contains the material to be sprayed and the bottom of the plunger tube contains a spring-urged valve assembly which, when the plunger tube is fully extended into the outer tube, fully opens to dispense a fixed quantity of material into a receiving well at the bottom of the plunger tube.

Pollak, U.S. Pat. No. 2,743,847, describes a mixing and dispensing apparatus for mixing and dispensing a liquid antiseptic with quantities of water. The apparatus consists of a cylindrical container which is adapted to be secured to a water outlet and which contains a main mixing and water storing chamber, a liquid chemical storage chamber mounted above the mixing chamber, means for dispensing and mixing a measured quantity of liquid chemical solution of water in the main chamber and control means controlling the entry of water and discharge of a mixture of water and liquid chemical solution, respectively.

Hein, U.S. Pat. No. 1,563,627, describes a hypodermic syringe construction wherein the solution to be ejected is adapted to be contained within a vial or ampule which is used as a piston within the syringe in filling the syringe and ejecting the fluid therefrom.

Leitch, U.S. Pat. No. 1,220,243, describes a flush tank for dental use where a manually-operable pump pressurizes fluid in a reservoir. However, an output conduit is attached at the top of the reservoir through a vacuum jacket, above the fluid level, and extends into the fluid in the reservoir. There is no output opening in the reservoir below the fluid and no output valve which would allow an output conduit to be connected and disconnected.

Heretofore, none of the prior art fluid dispensing devices embodied a simplified apparatus for providing a directed stream of fluid where an output conduit could selectively be connected to a reservoir or where an output valve maintains pressurized fluid in the reservoir when the conduit was not connected. The invention described in this application is directed to a pressurized fluid dispensing apparatus which overcomes problems in prior fluid dispensing devices and is able to precisely and controllably supply solutions in dentistry, medicine, veterinary medicine, industrial and commercial fabrications and various other uses.

SUMMARY OF THE INVENTION

The present invention relates to pressurized fluid dispenser which provides a directed fluid stream at a desired precise location. In one embodiment, the dispenser has a fluid reservoir fillable through an opening which has a removable cap. A manually-operable pump introduces gas, preferably compressed air, into the reservoir through a one-way check valve. The compressed air forces fluid in the reservoir through an outlet conduit that is controlled by a check valve which is opened after an output conduit is connected. The connector can be designed so that the check valve is automatically opened when the output conduit is connected.

A handpiece is mounted on the output conduit for directing a stream of fluid to a precise location such as, for example, to soft gingival tissue around the teeth. The handpiece can be connected through flexible tubing to a nose piece, with an integral cannula having a side discharge window. A control valve in the form of a slidable wheel operates to pinch the flexible conduit to control fluid flow through the cannula. The handpiece can have removable cannulas. The pump includes a manually operated plunger which moves within a chamber formed integrally with the fluid reservoir chamber with guides provided to maintain proper alignment of the shaft.

The invention provides several benefits and advantages. A quick connection between a flexible outlet conduit and the reservoir allows the joining of the conduit to the pressurized reservoir to a manually controlled handpiece designed to precisely deliver desired amounts of solutions, liquids or fluids into specific sites or locations. For example, the pressurized fluid dispensing apparatus of the invention is adaptable to dental cleansing usages such as the lavage of root canal preparations, periodontal pockets, gingival sulci, furcations, implant sockets, extraction sockets, pericoronal infections or other sites or infected areas in the oral cavity. The apparatus may also be used to perform various medical or veterinary lavaging treatments for infections in the nostrilla, external auditory meatuses, draining fistula or other infected areas in mammalian bodies. The apparatus of the invention is further adaptable to many common commercial or industrial uses, such as the precise application of adhesives or lubricants.

A further benefit of the invention is that the manual pump is formed integral with the reservoir. The apparatus provides a completely mobile, self-contained, pressurized dispensing device that does not rely upon any form of electrical power or motors or connections with sources of electricity, fluids or compressed air and has a minimum number of movable parts. Without such a reciprocating pumping apparatus, fluid is dispensed it a constant flow rate and not in a pulsating manner as in many known devices that use electric pumps.

The device may be economically manufactured through, for example, a molding process employing elastomeric materials, such as plastics, or through machining and casting processes using metals, plastics or combinations thereof.

BRIEF DESCRIPTION OF THE DRAWINGS

A better understanding of the invention can be obtained when the exemplary embodiment of the invention described below is considered along with the appended drawings, in which:

FIG. 3 is a horizontal cross-sectional view of the pressurized fluid dispensing device looking along section line 3—3 in FIG. 1;

FIG. 4 is a cross-sectional view of the pumping chamber of the pressurized fluid dispensing apparatus looking along section line 4—4 in FIG. 3;

FIG. 5 is a broken cross-sectional view of the base of the pressurized fluid dispensing device looking along section line 5—5 in FIG. 3, showing in particular an outlet valve to which a flexible output conduit can be connected;

FIG. 7 is a cross-sectional view of a portion of a handpiece mounted on the output conduit and showing, in particular, a sliding pinch valve for controlling fluid flow through the conduit;

DETAILED DESCRIPTION OF AN EXEMPLARY EMBODIMENT

Figure 1:
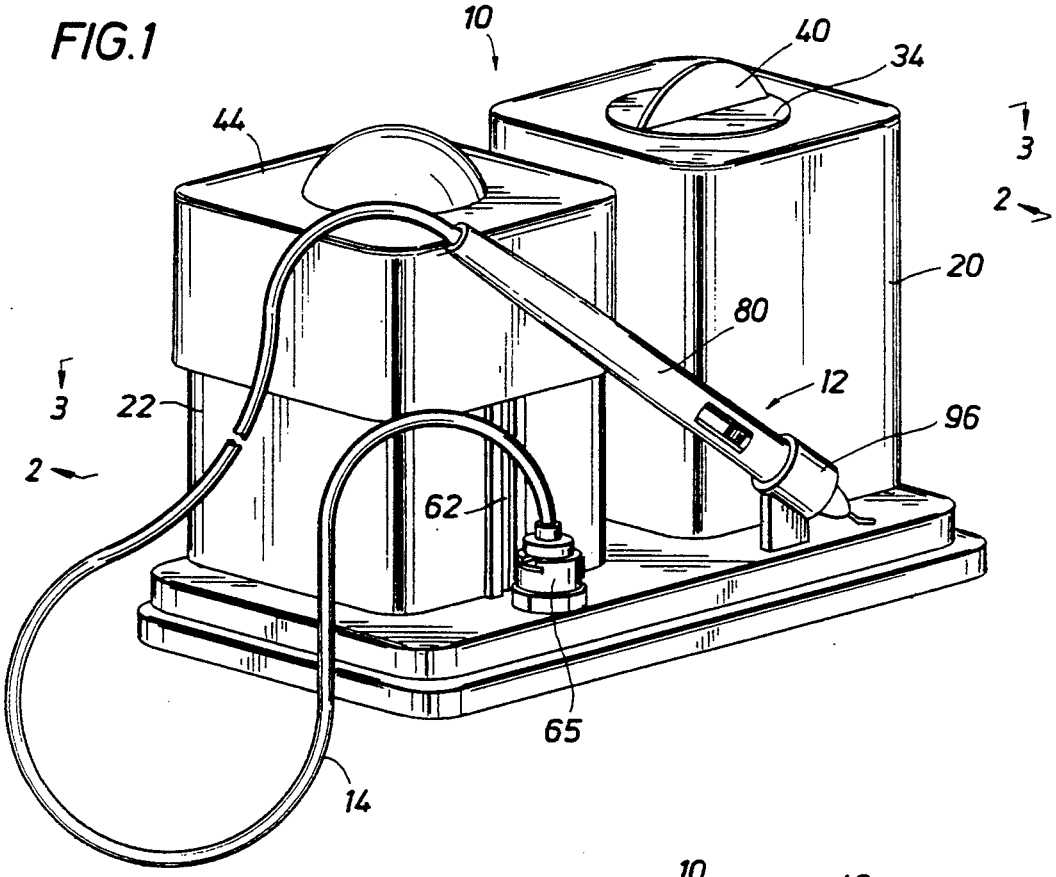
FIG. 1 is a perspective view of the pressurized fluid dispensing device of the present invention.

The invention is directed to a pressurized fluid dispensing apparatus for use with a handpiece that can direct fluid to exact locations in a steady stream. FIGS. 1–8 illustrate an exemplary embodiment of the invention where a pressurized fluid dispensing apparatus 10 is shown along with a dental handpiece 12 that is connected through a flexible conduit 14.

The dispensing apparatus 10 includes an upper housing 16 and a base portion 18 formed of pressure molded elastomeric materials well known to those skilled in the art. Alternatively, these components may be formed of cast or machined metals, plastics or other suitable materials. The upper housing section 16 has a pair of generally rectangular compartments 20, 22 which are hollow inside, as shown in particular in FIG. 2, so as to form a reservoir 24 inside the two compartments and a communication passage 26 located between the compartments 20, 22.

Figure 2:
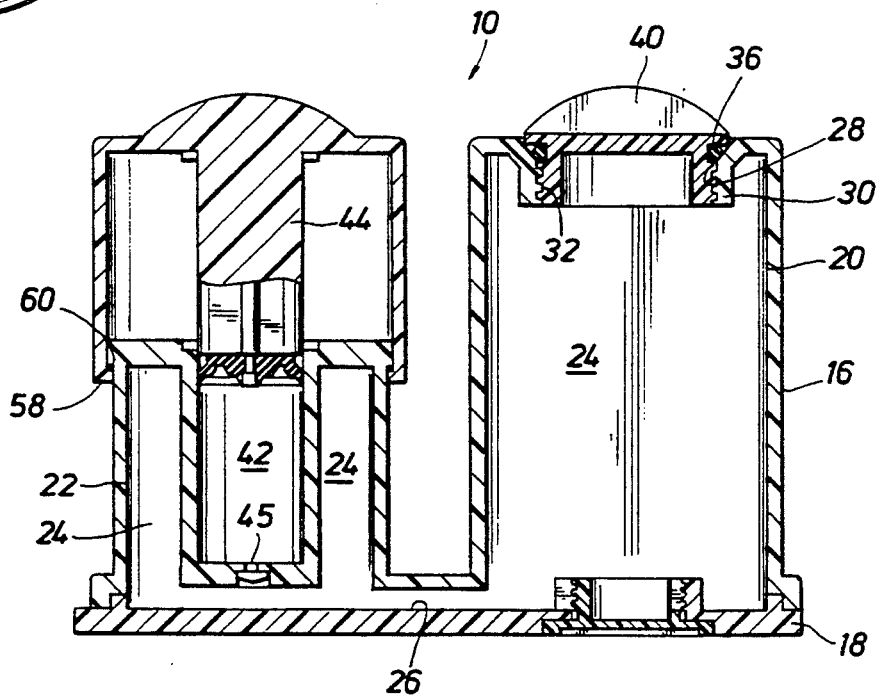
FIG. 2 is a vertical cross-sectional view of the reservoir and integral chamber of the pressurized fluid dispensing device looking along section line 2—2 in FIG. 1.
Figure 6:
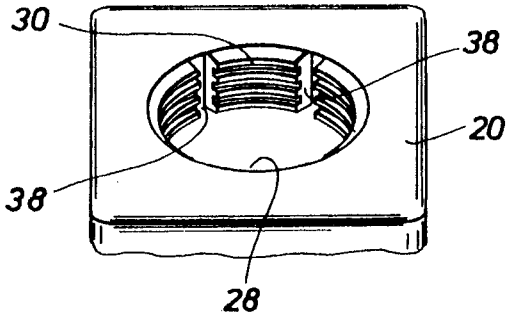
FIG. 6 is a perspective view of a portion of the opening of the fluid dispensing device through which fluid is introduced.

Liquid is introduced into the reservoir 24 through an opening 28 formed in the compartment 20, the opening 28 having a skirt 30 that projects into the reservoir 24 which is threaded to mate with threads 32 formed on a cap 34. An O-ring seal 36 is mounted onto cap 34 to seal the reservoir 24 when the cap 34 is threaded into the opening 28 as shown in FIGS. 1 and 2. The skirt 30 has four slots 38 spaced around its periphery as shown in FIG. 6 so that when the dispensing apparatus 10 is tilted all the liquid remaining in the reservoir can be poured out. The cap 34 has a handle 40 which can easily be grasped for inserting and removing the cap 34.

A removable plug 35 is provided in the bottom of the compartment 20, which mates with threads formed in a skirt 37 that is formed similarly to the skirt 30 (FIG. 6) with slots (not shown) so all the liquid in the reservoir 24 can be poured out when the plug 35 is removed. The plug 35 has a key slot 39 on its outer surface so it can easily be removed, and an O-ring seal 41 to prevent leakage.

The compartment 22 has a pump chamber 42 which connects to the reservoir 24 through a one-way check valve 45, as shown in FIGS. 2 and 4. A plunger 44 cooperates with the pump chamber 42, which is manually operated in order to provide a positive fluid pressure in the reservoir 24.

As shown best in FIGS. 3 and 4, the compartment 22 also includes a pair of cylindrical columns 46, 48 which cooperate with a pair of posts 50, 52 formed in the plunger 44, by holding a pair of compression springs 54, 56, respectively, which maintain the plunger section 44 in the upward position shown in FIGS. 2 and 4. When the plunger section 44 is pushed downwardly with a force great enough to overcome the resistance of the springs 54, 56, the plunger 44 moves downwardly and pumps air through the one-way valve 45 into the reservoir 24. The springs 54, 56 operate to move the plunger 44 back to its upper most position shown in FIGS. 2 and 4 when the force is removed.

A flange 58 is formed around the bottom edge of the plunger 44, which engages a lip 60 formed on the compartment 22 to prevent the plunger 44 from moving out of engagement with the compartment 22. The outer surface of the compartment 22 is formed with a track 62, shown in FIGS. 1 and 3, on two of its sides which cooperates with a projection 64 formed on the inner surface of the plunger 44 to maintain proper alignment between the plunger 44 and the compartment 22 as the plunger 44 moves. Thus, in order to pressurize the reservoir 24, a user depresses the plunger 44 several times, the amount of pumping depending on the fluid level in the reservoir 24.

The handpiece 12 is connected to the reservoir 24 through a flexible conduit 14 and a normally-closed valve generally designated by reference numeral 65, shown in FIGS. 1 and 5. The valve 65 includes a stop in the form of a small ball 66 which is normally urged against an opening 67 by of a coil spring 68. When a male connection 70, which is connected to the flexible tubing 14 through the ribbed connection end 71, is inserted into the valve 65, an outer end 72 of the connector 70 engages a stem 74 connected to the ball stop 66 and overcomes the force of the spring 68, removing the ball stop 66 from the opening 67 and allowing fluid to flow from the reservoir 24 to the handpiece 12.

The male connector 70 is maintained in place in the valve 65 by a sliding handle 76 which is urged toward its locking position by a spring 78. In order to insert the male connector 70, the handle 76 is pushed to the left as shown in FIG. 5. After the male connector 70 is in place, the spring 78 urges the handle back to the locking position where the handle 76 engages a slot 79 formed on the connector 70.

The handpiece 12 includes an elongated cylindrical housing 80 through which the flexible tubing 14 extends, as shown in FIG. 7. The housing 80 includes a pinch valve 82 formed of a roller 84 with axial projections 86 that are held by a pair of ramps 88 formed in the housing 80, which allow the user to push the roller 84 into engagement with the flexible tubing 14, thereby pinching it and closing off the flow of fluid through the flexible tubing 14. When the connector 70 is in place, as shown in FIG. 5, the valve 65 is opened and the flow of fluid through the flexible tubing is regulated by the pinch valve 82.

Figure 8:
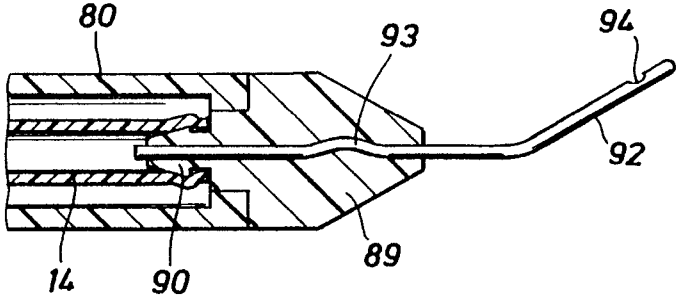
FIG. 8 is a cross-sectional view of a nose piece for the handpiece which shows, in particular, the connection to the flexible conduit.

A nose piece 89 is mounted on the outer end of the housing 80 through adjacent surfaces that engage each other through a friction fit, shown in FIG. 8. The nose piece 89 also includes a tubular projection 90, with a ribbed outer surface, for receiving the outer end of the flexible tubing 14. An irrigating tip or cannula 92 is mounted in the tubular projection 90 and held in place by molding the plastic nose piece 89 over the cannula 92, which has a kink 93 along its end so it cannot easily be pulled out of the nose piece 89. An opening 94 is formed on the cannula 92 so fluid can be directed to a desired location when the sliding valve member 84 is in its open position and the apparatus 10 is pressurized. When the irrigation operation is completed, the roller 84 is moved to its closed position to pinch the flexible tubing 14 in order to interrupt fluid flow. A holding sleeve or ring 96 is mounted on the apparatus 10 for holding the handpiece 12 when it is not in use.

Figure 9:
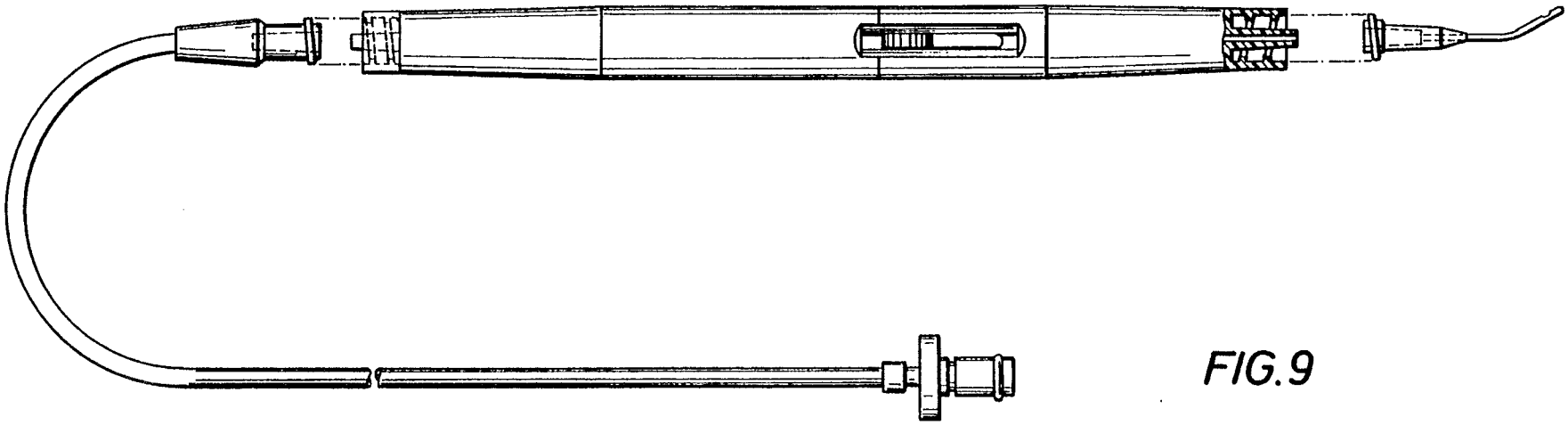
FIG. 9 is a plan view, partially in section, of a second embodiment of the handpiece.

Another embodiment of a handpiece 96 is shown in FIG. 9 where a nose piece 98 and flexible conduit section 100 are made to be easily connected and disconnected from the handpiece 96. The nose piece 98 is formed with an internal chamber 102 that mates with a conical projection 104 in the handpiece 96 when a flange or tab 106 is screwed into threads 108.

A similar connection is formed at the other end of the handpiece where a connector 110 is mounted on one end of the flexible conduit 100, which includes an internal chamber 112 and flange 114 that mate with a conical projection 116 and threads 118 formed on the handpiece 96. These connectors allow the nose piece 98, handpiece 96, and flexible conduit section 100 to be disconnected and stored or replaced when desired.

A length of flexible conduit 120 is connected inside the handpiece 96, between a pair of tubular projections (not shown) similar to the projection 90 shown in FIG. 8, for engagement with a pinch valve 82 as shown in FIG. 7. A similar tubular projection (not shown) is formed in the connector 110 so it can be connected to the flexible conduit 100.

In this way, a manually operable fluid dispensing system is provided which allows for high-level irrigation of subgingival locations or other areas where non-pulsating directed fluid flow is desirable. This is done through the use of a device which is highly efficient and does not require the use of any electrical power.

The handpiece connects quickly to the pumping unit, snapping into place with a solid, audible click for a water-tight seal. The handpiece fits comfortably in the hand and allows easy positioning in the mouth and in hard to reach areas. Because of the valve which automatically opens when the flexible tubing is connected to the reservoir, on/off operation is easily accomplished through the simple movement of the roller 84 located on the handpiece. Because of the seals in the unit, it can be stored with the fluid under pressure for extended periods of time so that it can be used when desired.

The invention is defined in the appended claims, which are not considered to be limiting but should be given their full intended scope and include all modifications and variations of the preferred embodiment described above which fall within the spirit and intended scope of the invention.

We claim:

1. A pressurized liquid dispensing apparatus, comprising:

a) a sealed reservoir for holding said to be dispensed under a positive pressure;

b) input means through which said liquid can be introduced into the reservoir, and seal means operatively associated with the input means for maintaining liquid in the reservoir under a positive pressure;

c) pump means including an elongated pump chamber for pumping a gas under pressure into the reservoir;

d) one-way valve means located at one end of the chamber between the reservoir and pump means for allowing gas to be introduced into the reservoir by the pump means and preventing liquid in the reservoir from flowing through the one-way valve means into the pump means;

e) output valve means in communication with the reservoir which is closeable for preventing liquid from flowing out of the reservoir;

f) an output conduit, and connecting means for selectively connecting one end of the output conduit to the output valve means;

g) means for opening the output valve means when said one end of said output conduit is connected to the output valve means so that liquid under pressure in the reservoir can flow through the output valve means;

h) a housing in which the reservoir and pump means are formed, the pump means including plunger means movable relative to the housing; and i) spring means for urging the plunger means away from the one-way valve means;

a pair of hollow columns on opposite sides of the pump chamber, the plunger means including a pair of posts sized and shaped to fit in the columns, and the spring means including a pair of compression springs for cooperating with the columns and posts.

2. The apparatus of claim 1, wherein the plunger means and housing include cooperating stop means for limiting movement of the plunger means.

3. The apparatus of claim 1, wherein the pump chamber and reservoir are formed adjacent to each other, the housing including a hollow base portion for connecting the pump chamber and reservoir.

4. A pressurized liquid dispensing apparatus, comprising:

a) a sealed reservoir for holding liquid to be dispensed under a positive pressure;

b) input means through which said liquid can be introduced into the reservoir, and seal means operatively associated with the input means for maintaining liquid in the reservoir under a positive pressure;

c) pump means including an elongated pump chamber for pumping a gas under pressure into the reservoir;

d) one-way valve means located at one end of the pump chamber between the reservoir and pump means for allowing gas to be introduced into the reservoir by the pump means and preventing liquid in the reservoir from flowing through the valve means into the pump means;

e) output valve means in communication with the reservoir which is closeable for preventing liquid from flowing out of the reservoir;

f) an output conduit, and connecting means for selectively connecting one end of the output conduit to the valve means;

g) means for opening the output valve means when said one end of an output conduit is connected to the output valve means so that liquid under pressure in the reservoir can flow through the output valve means, wherein the input means includes a circular flange projecting into the reservoir defining an input opening, the flange having threads on its inner surface, the input opening further including a cap forming said seal means with threads on its outer surface adapted to engage the threads in the flange, a seal ring disposed between the cap and the input opening, and at least one slot in the flange extending to the inner surface of the reservoir for allowing substantially all the liquid in the reservoir to be emptied.

5. The apparatus of claim 1, wherein the output valve means includes a closure member, movable between open and closed positions, and a spring for urging the closure member toward the closed position, the closure member being urged toward the open position when said one end of said output conduit is connected to the output valve means.

6. The apparatus of claim 5, and further including a quick release means associated with the connecting means.

7. The apparatus of claim 6, wherein the output conduit comprises a flexible conduit, and further including a slide control pinch valve means for varying fluid flow through the output conduit.

8. The apparatus of claim 7, wherein the slide control means includes a guide, and a roller movable in the guide for selectively pinching the flexible conduit.

9. The apparatus of claim 7, and further including a handpiece for housing the pinch valve means.

10. The apparatus of claim 9, and further including separate conduit sections for connecting the handpiece with the reservoir and internal of the handpiece, and means for disconnecting the handpiece from the separate conduit section for connecting the handpiece with the reservoir.

11. The apparatus of claim 9, and further includes a nosepiece and a cannula held by the nose piece in fluid communication with the flexible conduit, and means for disconnecting the nose piece and cannula from the flexible conduit.

12. A pressurized liquid dispensing apparatus comprising:

a sealable reservoir for holding liquid to be dispensed under a positive pressure;

means for introducing the liquid into the reservoir;

means for controlling the flow of the liquid out of the reservoir;

pump means for pumping a gas under pressure into the reservoir, the pump means comprising:

an elongated pump chamber, with a one-way valve means at one end has been inserted after "chamber";

plunger means movable relative to the pump chamber;

spring means located outside the pump chamber for urging the plunger means away from the one-way valve means the spring means including at least two compression springs each positioned within a hollow column outside the pump chamber, and each spring cooperating with a post designed to fit within the column.

13. The apparatus of claim 12, wherein the pump means further comprises:

guide means for maintaining proper alignment between the plunger means and the pump chamber.

14. The apparatus of claim 13, wherein the guide means includes at least one cooperating track and projection formed between the pump chamber and the plunger means.

* * * * *